US008814293B2

(12) United States Patent
Strunk et al.

(10) Patent No.: US 8,814,293 B2
(45) Date of Patent: Aug. 26, 2014

(54) ON-CHIP FLUID RECIRCULATION PUMP FOR MICRO-FLUID APPLICATIONS

(75) Inventors: Timothy L. Strunk, Georgetown, KY (US); Yimin Guan, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 262 days.

(21) Appl. No.: 13/349,933

(22) Filed: Jan. 13, 2012

(65) Prior Publication Data

US 2013/0182022 A1 Jul. 18, 2013

(51) Int. Cl.
*B41J 29/38* (2006.01)

(52) U.S. Cl.
USPC ..... 347/6

(58) Field of Classification Search
None
See application file for complete search history.

(56) References Cited

U.S. PATENT DOCUMENTS

| | | | | |
|---|---|---|---|---|
| 4,318,114 | A | 3/1982 | Huliba | |
| 6,283,718 | B1 * | 9/2001 | Prosperetti et al. | 417/52 |
| 6,431,694 | B1 | 8/2002 | Ross | |
| 6,655,924 | B2 | 12/2003 | Ma | |
| 6,685,303 | B1 | 2/2004 | Trauernicht | |
| 6,869,273 | B2 | 3/2005 | Crivelli | |
| 7,374,274 | B2 | 5/2008 | Cornell | |
| 2006/0038852 | A1 * | 2/2006 | Cornell | 347/54 |
| 2012/0007921 | A1 * | 1/2012 | Govyadinov et al. | 347/54 |
| 2013/0057622 | A1 * | 3/2013 | Govyadinov et al. | 347/85 |
| 2013/0155135 | A1 * | 6/2013 | Govyadinov et al. | 347/10 |

OTHER PUBLICATIONS

JR-Hung Tsai and Liwei Lin, A Thermal-Bubble-Actuated Micronozzle-Diffuser Pump, Journal of Microelectromechanical Systems. vol. 11, No. 6. Dec. 2002.

Jung-Yeul Jung and Ho-Young Kwak, Fabrication and Testing of Bubble Powered Micropumps using Embedded Microheater, Research Paper, Department of Mechanical Engineering, Chung-Ang University, Seoul, South Korea, Received Jun. 16, 2006, Accepted Aug. 1, 2006, Published online Sep. 16, 2006, Springer-Verlag.

D.J. Laser and J.G. Santiago, A review of Micropumps. Journal of Micromechanics and Microengineering, 14(2004) p. R-35-R-64, Institute of Physics Publishing.

Jun et al., Microscale Pumping with Traversing Bubbles in Microchannels, Solid-State Sensor and Actuator Workshop, Hilton Heard Island, South Carolina, Jun. 3-6, 1996.

* cited by examiner

*Primary Examiner* — Geoffrey Mruk
*Assistant Examiner* — Bradley Thies

(57) ABSTRACT

A micro-fluid ejection head has fluid ejection elements formed as thin film layers on a substrate. Fluid flow features on the substrate channel fluid from a fluid source to ejection chambers surrounding the ejection elements. A pump on the substrate circulates the fluid from the source to the ejection chambers and back again to the source. The flow refreshes the fluid in the chambers to minimize deleterious effects of evaporation. A controller coordinates the flow rate of the pump and other variables to optimize system productivity. Other embodiments contemplate pump locations, pump types, pump enumeration, and fluidic features, such as pathways, diffusers, chokes and dimensions, to name a few.

21 Claims, 10 Drawing Sheets

ON-CHIP FLUID RECIRCULATION PUMP FOR MICRO-FLUID APPLICATIONS

FIELD OF THE INVENTION

The present invention relates to micro-fluid ejection applications. It includes inkjet printing. Although not exclusively, the invention particularly relates to ejection chips having pumps to (re)circulate fluid through ejection chambers to keep fluid fresh for ejection. Pump design and placement and fluid channel design and placement facilitate the embodiments.

BACKGROUND OF THE INVENTION

The art of printing with micro-fluid technology is relatively well known. A permanent or semi-permanent ejection head has access to a local or remote supply of fluid (e.g., ink). The fluid ejects from an ejection zone to a print media in a pattern of pixels corresponding to images being printed. Over time, the heads and fluid drops have decreased in size. Multiple ejection chips joined together are known to make large arrays, such as page-wide printheads.

In any configuration, imaging devices notoriously waste ink during maintenance operations. The larger the printhead, the more the imaging device wastes it. A page-wide head supporting 100,000 nozzles or more consumes as much as twenty times the volume of fluid of a scanning head supporting around 5,000 nozzles operated under comparable situations. The consumption wastes a quarter to a half or more of a page-wide imaging device's fluid supply on maintenance alone.

The amount of fluid actually consumed during these maintenance cycles varies greatly in page-wide devices according to usage. The heavier the usage, the fewer maintenance routines the imaging device requires to keep fresh its fluid in nozzles for printing, and vice versa. Heavy users who print frequently or who print large, multi-page imaging jobs may see only 15% or so of its fluid spent on jetting maintenance, while lighter users who print infrequently or who print smaller-sized imaging jobs may see 80% or more of its ink wasted on maintenance. There are needs in the art to overcome this problem. Any devised solutions must also appreciate that these maintenance routines prematurely shorten the life of printheads. To the extent usage dictates that only 80% of fluid ejections correspond to maintenance routines, such as those associated with light usage, only 20% of the printhead life is then available for actual imaging and needs addressing.

Requirements with heads also exist to continually keep fresh fluid for imaging. They relate primarily to water loss from the fluid that evaporates through jetting nozzles exposed to ambient conditions. As losses in their severest form can prevent the proper formation of ejection bubbles in firing chambers, imaging devices regularly cap dormant nozzles of printheads. During uncapped times, however, evaporation can occur so rapidly that imaging devices with scanning printheads periodically conduct maintenance jetting of unused nozzles when they pass outside the width of the print media at the end of a scan line. The frequency of jetting corresponds to the characteristics of the fluid. It relates to a fluid's "idle time." A common idle time suggests that nozzles jet during imaging or maintenance every one to two seconds to prevent fluid from drying and clogging nozzles. Unfortunately, page-wide printheads can never scan outside the boundaries of an imaging width of a print media and cannot be jetted at ends of scan lines during times of nozzle uncapping like their scanning head counterparts. On the other hand, page-wide heads can be fired for maintenance between pages of an imaging job and/or before a first page and after a last page. Assuming a print speed in a page-wide configuration of one page per second, and using common idle times, each nozzle in a page-wide head requires a minimum of several firings between pages. This unfortunately further shortens the life of jetting actuators.

Accordingly, a need exists in imaging devices to better maintain nozzle health of printheads, especially in large micro-fluid arrays. The need extends not only to minimizing fluid waste during maintenance, but to lengthening head life by curtailing harmful jetting practices. Concomitant benefits that shorten fluid idle time are also sought when devising solutions. By loosening idle time restrictions regarding firing frequency of jetting actuators, ink formulations may be made free to evolve more naturally. Still other alternatives and benefits are sought with implementations of the invention.

SUMMARY

The above-mentioned and other problems become solved with an on-chip fluid recirculation pump for micro-fluid applications. The embodiments include circulating fresh fluid (ink) through ejection chambers to ready them to fire while minimizing operational maintenance. Fresh flowing ink fights evaporation, avoids wasteful fluid spitting during maintenance and extends printhead life. The improvements are especially useful when implemented in an imaging device having a page-wide printhead array.

In a representative embodiment, a micro-fluid ejection head has fluid ejection elements formed as thin film layers on a substrate. Fluid flow features on the substrate channel fluid from a fluid source to ejection chambers surrounding the ejection elements. A pump on the substrate circulates the fluid from the source to the ejection chambers and back again to the source. A controller coordinates the flow rate of the pump and other variables to optimize system productivity. Further features contemplate pump location, pump type, pump enumeration, and fluidic features, such as pathways, diffusers, chokes and dimensions, to name a few.

These and other embodiments will be set forth in the description below. Their advantages and features will become readily apparent to skilled artisans. The claims set forth particular limitations.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE ILLUSTRATED EMBODIMENTS

In the following detailed description, reference is made to the accompanying drawings where like numerals represent like details. The embodiments are described in sufficient detail to enable those skilled in the art to practice the invention. It is to be understood that other embodiments may be utilized and that process, electrical, and mechanical changes, etc., may be made without departing from the scope of the invention. The following detailed description, therefore, is not to be taken in a limiting sense and the scope of the invention is defined only by the appended claims and their equivalents. In accordance with the present invention, methods and apparatus teach on-chip fluid recirculation pump(s) for micro-fluid applications, such as inkjet printing.

Figure 1:
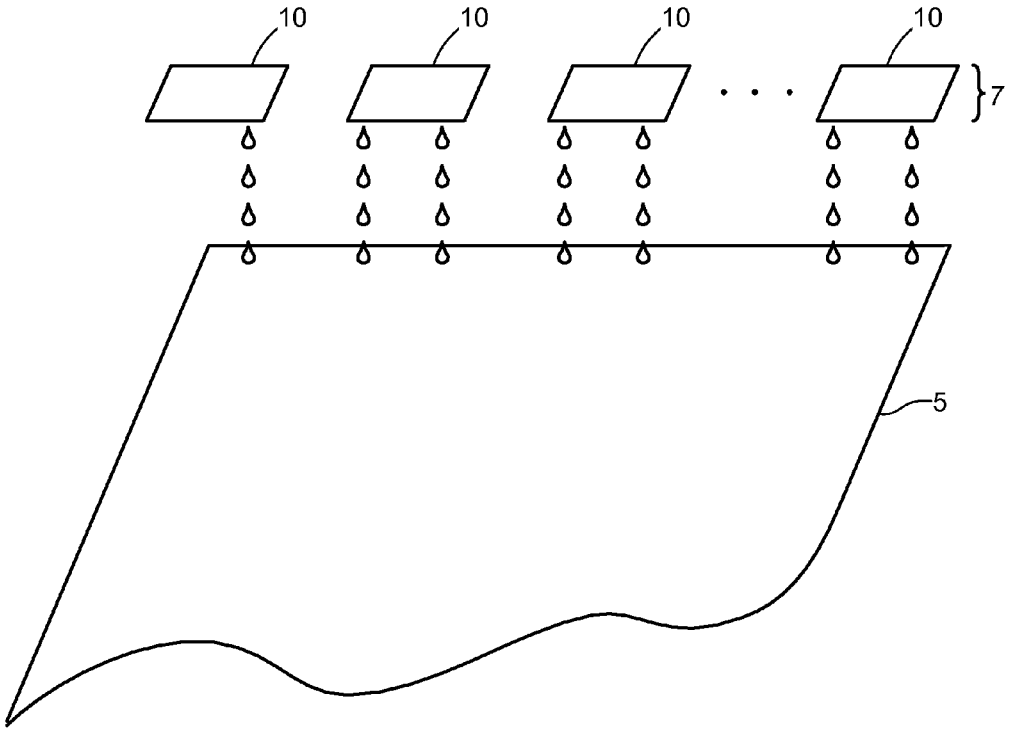
FIG. 1 is a diagrammatic view in accordance with the teachings of the present invention of a micro-fluid application sporting ejection chips for imaging media.

With reference to FIG. 1, pluralities of ejection chips 10 are configured in an array 7 across a print media 5 to ejection fluid. The array includes as few as two chips, but as many as necessary to cover a width of the media. The array is variable in length, but is commonly two inches or more depending upon application. Arrays of 8.5" or more are contemplated for imaging page-wide media in single pass printing. The arrays can be used in micro-fluid ejection devices, e.g., printers, having either stationary or scanning ejection heads. Alternatively, ejection devices can be configured with singular ejection chips in lieu of arrays.

Figure 2:
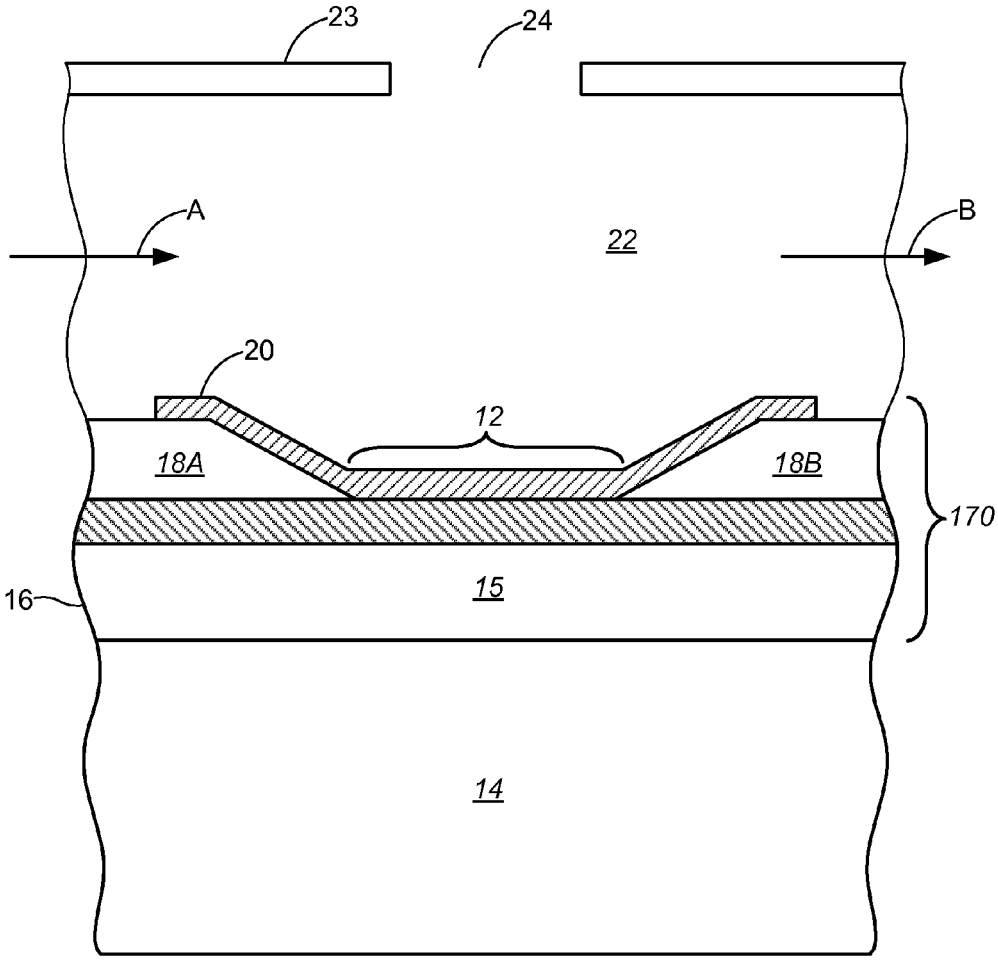
FIG. 2 is a diagrammatic view of a fluid ejection element and a stack of thin film layers defining a fluid pump.
Figure 4:
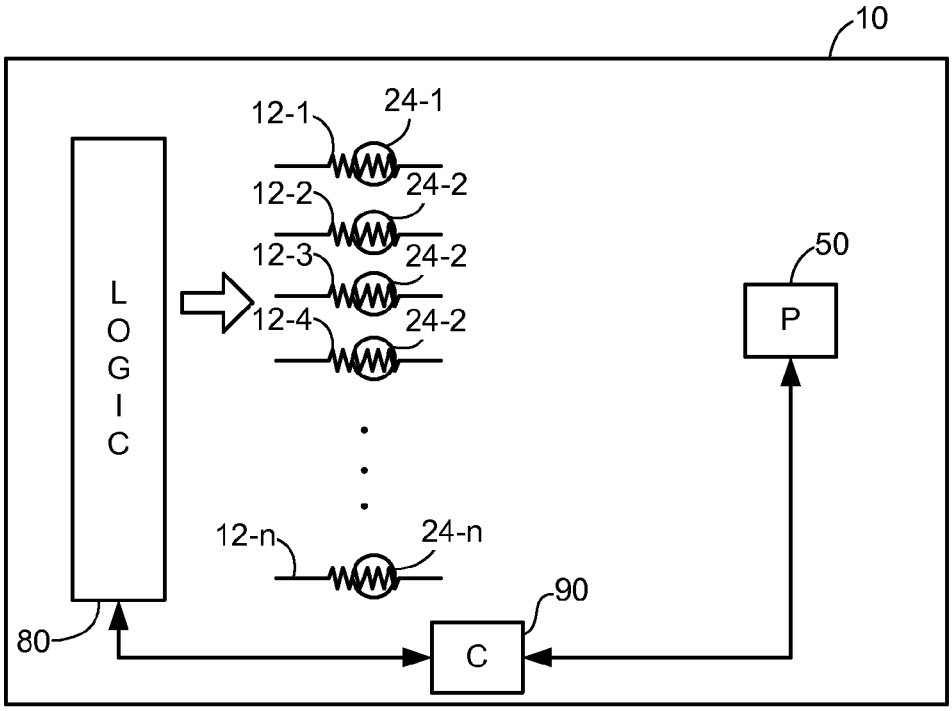
FIG. 4 is a diagrammatic layout of a control system for an ejection chip.

With reference to FIG. 2, each chip includes pluralities of fluid ejection elements 12. The elements expel or jet fluid from the chip at times pursuant to commands of a printer microprocessor or other controller 90 (FIG. 4). The timing corresponds to a pattern of pixels of an image being printed on the media. The elements are spaced on the chip to facilitate imaging. Familiar spacing distances correlate to $1/900^{th}$ or $1/1200^{th}$ of an inch between adjacent elements.

Each ejection element 12 is any of a variety, but embodiments include resistive heaters, piezoelectric transducers, MEMS displacement pumps, or the like. They are formed as thin films on a substrate 14, such as silicon or other base material. Formation includes, but is not limited to, growing layers on the substrate, depositing layers, evaporating layers, sputtering layers, etc., and may include photolithography, patterning, and etching techniques to define precise physical arrangements of the layers. In order away from the substrate 14, an exemplary resistive heater includes but is not limited to: a field oxide and/or barrier layer 15; a resistor layer 16; an electrode layer 18 (bifurcated into positive and negative electrode sections, i.e., anodes and cathodes); and a protective/cavitation layer 20.

The substrate 14 defines the base layer. It comprises a base material, such as an insulator, silicon, or other. If a silicon wafer, a representative material includes p-type conductivity with 100 orientation having a resistivity of about 5-20 ohm/cm. Its thickness varies but typically greatly exceeds the thickness of the thin film layers thereon.

The field oxide is a layer grown or deposited on the substrate in an amount of about 8,000 to 10,000 Angstroms. It typifies silicon oxide to provide thermal protection. It optionally includes an overcoat, of glass (7,000-8,000 Angstroms), such as BPSG (boron, phosphorous, silicon, glass), PSG (phosphorous, silicon, glass) or PSOG (phosphorous, silicon oxide, glass). The barrier layer may be a contiguous single layer or multiple discrete layers.

The resistive layer 16 overlies the barrier layer. It is formed of a resistor material that causes the ejection of fluid (e.g., ink) upon the application of electrical energy. Its material is any of a variety, but is regularly a mixture of tantalum, aluminum, and nitrogen having a thickness from a few hundred Angstroms to 1000 Angstroms, or more. Other designs contemplate materials of nickel chromium or titanium nitride. In still other designs, pure layers or mixtures include hafnium, Hf, tantalum, Ta, titanium, Ti, tungsten, W, hafnium-diboride, $HfB_2$, Tantalum-nitride, $Ta_2N$, TaAl(N,O), TaAlSi, TaSiC, Ta/TaAl layered resistor, Ti(N,O) or WSi(O). Suitable impurities, such as oxygen, nitrogen, carbon, etc., may find usefulness in adjusting the resistivity of the layer 16 to a desired level.

An electrode layer 18 overlies the resistor layer. It is split into anode 18A and cathode 18B sections on separate portions of the resistor. It is energized to apply electrical energy to the resistor layer. Material sets include copper, gold, silver, aluminum, or any other conductor/mixture. The layer is uniformly thick and ranges from about 3,000-5,000 Angstroms.

Above the electrode is a protective/cavitation layer 20. It overlies portions of both the electrode layer and the resistor layer (between the electrodes). It serves as passivation and/or cavitation protection for the ejection element during use. It includes mixtures of silicon, carbon, nitrogen, titanium, diamond like carbon, or other. It ranges from about 2,000-3,000 Angstroms. The layer is defined by one or more thin films, although only a singular layer is shown.

In the space beyond the protective/cavitation layer is an ejection chamber 22. It resides adjacent to the ejection element and provides a space for filling with fluid during use. Its shape and size serves in the formation of fluid bubbles and ejection of fluid. The fluid ejects from the chamber through a topmost ejection orifice ("nozzle") 24 aligned above the ejection element 12. The ejection orifice is made in a nozzle plate 23 that is either formed in place on the substrate as a thin film or is attached after alignment, such as by gluing. The chamber has fluid channels to carry fluid into and away (arrows A and B) from the chamber for ejection from the nozzle.

Figure 3:
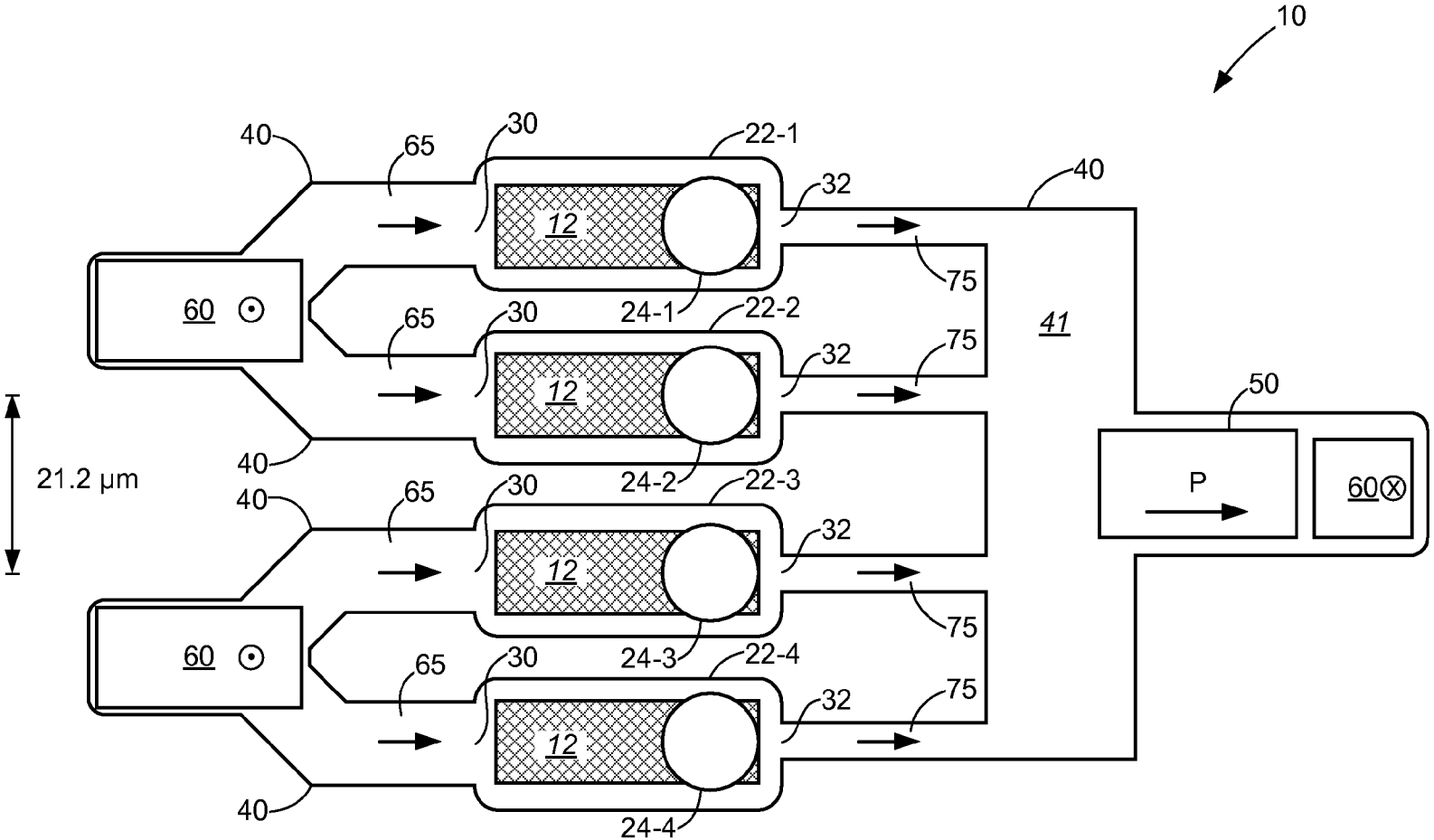
FIG. 3 is a diagrammatic view (partial planar) of an embodiment of an on-chip pump for micro-fluid applications.

With reference to FIG. 3, four ejection elements 12 are arranged adjacent to one another. (Although four are shown, any number of ejection elements is contemplated.) Each ejection element has a surrounding chamber 22. Each chamber 22 has a fluid inlet 30 and fluid outlet 32. Fluid arrives at the inlet 30 by way of channels or conduits 40 that also serve to carry fluid away from the chamber after passage through the fluid outlets 32. A pump 50 provides a motive force to circulate the fluid through the chamber and throughout the chip. The pump keeps fresh the fluid in the chamber for ejection. Fresh flowing fluid overcomes the deleterious effects of imaging with dehydrated fluid and letting dehydrated fluid dry up in channels and nozzles. It also obviates wasteful practices of spitting fluid from nozzles during maintenance routines simply to keep them from drying.

Following the path of fluid throughout the chip, the fluid originates at a local or remote source defined by a tank, bottle or other reservoir. It resides behind the ejector elements (into the paper (x), as drawn), but other embodiments may position it elsewhere. Ink channels 60 carry fluid back (x) and forth (·) to the source upon application of a pumping force from the pump 50. The fluid passes in the direction of the arrows.

When in the chamber, the fluid is made available for ejection from the orifice 24. After ejection, a small amount of fluid remains. It is dehydrated. The pump 50 draws it from the outlet 32 of the chamber and moves it back to the source. Once there, it recombines with large amounts of other fluid in the reservoir. The dehydrated fluid is mixed with hydrated fluid and suitable fluid properties are preserved for imaging. Fresh fluid is recycled back to the chamber 22 from the reservoir and made available for future fluid ejections.

Fluid also passes between the source and chamber by way of "tuned" fluid channels. The fluid passes first from the source to channels 60, which have large volume capacity. The fluid passes second to conduits 40, which have smaller volume capacity. The fluid here is said to be "choked," such as at position 65. Choking allows the chambers to refill at their operating frequency of fluid ejection (e.g., 10-20 Khz) to keep flowing a steady amount of fluid throughout the chip. The parameters for choking are variable, but include notions of preventing "too much" fluid from blowing back into the choke 65 upon ejection of a fluid bubble from the chamber 22. Preferred designs dictate that most of the bubble energy go toward fluid drop formation and ejection, rather than to fluid recapture in the choke or chamber. Designs also seek to minimize fluid "crosstalk" between adjacent ejection chambers 22-1, 22-2, 22-3, 22-4. As is expected, fluid flow, bubble formation, fluid ejection, etc. relative to one chamber should not be a cause of fluid disruption in any other chamber. Similarly, chokes 75 are designed on the fluid outlet side 32 of chambers 22.

Also, chokes 75 are designed to address flowing dehydrated fluid (having a higher viscosity than fresh, hydrated fluid) at the refresh pumping frequency of pump 50. In a preferred instance, the "refresh" chokes 75 are of even smaller volume capacity than the "supply" chokes 65 on the fluid inlet side of the chambers. In any design, all chokes 65, 75 should contemplate the variability of flow characteristics that come with differing chemical formulations and idle times from one ink to a next ink. On one hand, it is desired to maintain "low enough" flow resistance in the chokes to quickly replenish chambers 22 after fluid drop ejection, while on the other hand it is desired to achieve "high enough" flow resistance to prevent too much fluid from being "blown back" toward the fluid inlet side of the chamber after a fluid ejection event.

With reference to FIG. 4, an ejection chip 10 has logic circuitry 80 for addressing individual ejector elements 12 to fire or not during use. A controller 90 is used to coordinate the logic. The controller is also available to control the pump 50. In this way, pumping routines can be coordinated between the fluid flow rate of the pump and the rate of fluid refresh of the chambers. Particular routines to flow fluid through the chip can occur according to various predetermined factors, such as: 1) how often individual chambers have had fluid ejection events; 2) which chambers or groupings of chambers have had recent fluid ejection events; 3) whether or not and which chambers have had fluid ejection events per a current image being produced on the media, e.g., whether chambers are ejecting fluid on a particular page of the imaging job or per a particular zone of a given page of media; 4) whether chambers are ejecting fluid within a known idle time of the fluid; and/or 5) the degree to which the rate of evaporation of fluid slows as fluid dehydrates in chambers. As the fluid flow rate of the refresh pump is relatively very low compared to the flow rates necessary to refill chambers after fluid ejection events, the controller 90 can act to coordinate fluid refresh for many chambers 22 with but a single on-chip pump 50.

Figure 5:
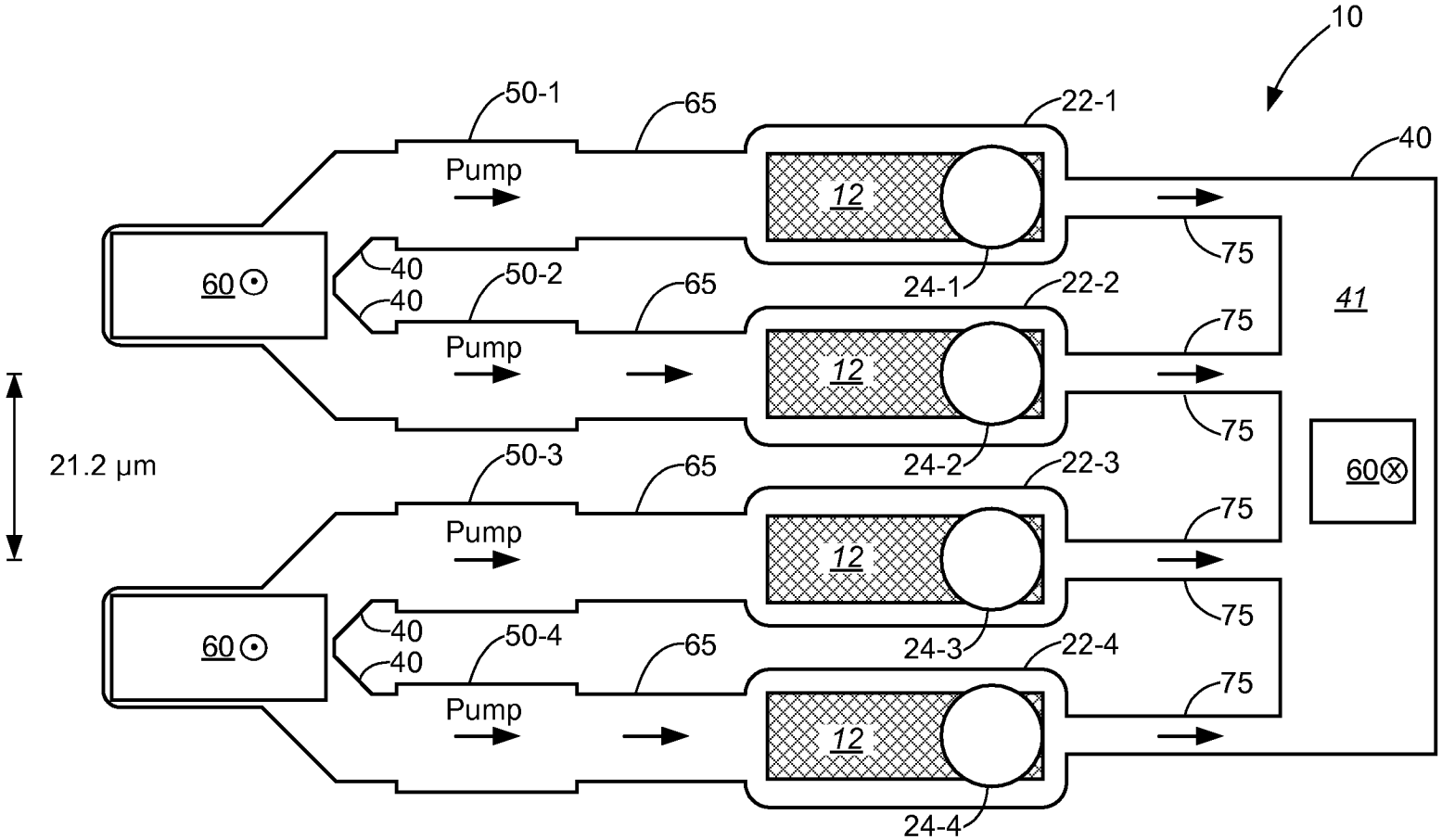
FIGS. 5-9 are diagrammatic views of alternate embodiments of on-chip pump(s) for micro-fluid applications.

With reference to FIG. 5, an alternate embodiment of the invention contemplates using more than one fluid pump aboard a single ejection chip 10.

The pumps 50-1, 50-2, 50-3, 50-4, are designed for use one per chamber 22-1, 22-2, 22-3, 22-4 or one pump per a few chambers (not shown). The pumps may be arranged on the fluid inlet side 30 (shown) or on the fluid outlet side 32 (not shown). In other regards, however, the pumps work as before to move fresh ink from a fluid source to chambers 22 and to move dehydrated fluid from the chambers back to the source. Supply and refresh chokes 65, 75 are contemplated as are fluid channels 60 and conduits 40. Advantages of a dedicated refresh pump per an individual chamber include, but are not limited to: 1) exceptionally limited cross-talk between adjacent nozzles; and 2) precise control of refresh pumping on a per-nozzle basis. An example of control assumes a refresh pump dedicated to a particular nozzle has the capacity to pump fluid volume that is three times (3×) the volume of a single fluid drop in a time period of 100 ms. With a refresh pump capacity on the order of 60 pl per second, and an imaging speed of one page per second, a single chamber 22 is needed to be refreshed with fluid every one-tenth of a page. Assuming further that an ink idle time is 0.5 seconds (or the time to print one-half a page), an ink rate of evaporation is one that slows down after 200 ms, and that the refresh pump can pump out dehydrated ink from a chamber up to five (5.0) seconds after no jetting events (and being an uncapped nozzle), then a simple health rule for refreshing fluid for a single nozzle would be refreshing any chamber that has not fired within the idle time of the ink, e.g., 0.5 seconds and undertaking maintenance jetting of the nozzle between imaging pages to optimize performance.

Figure 6:
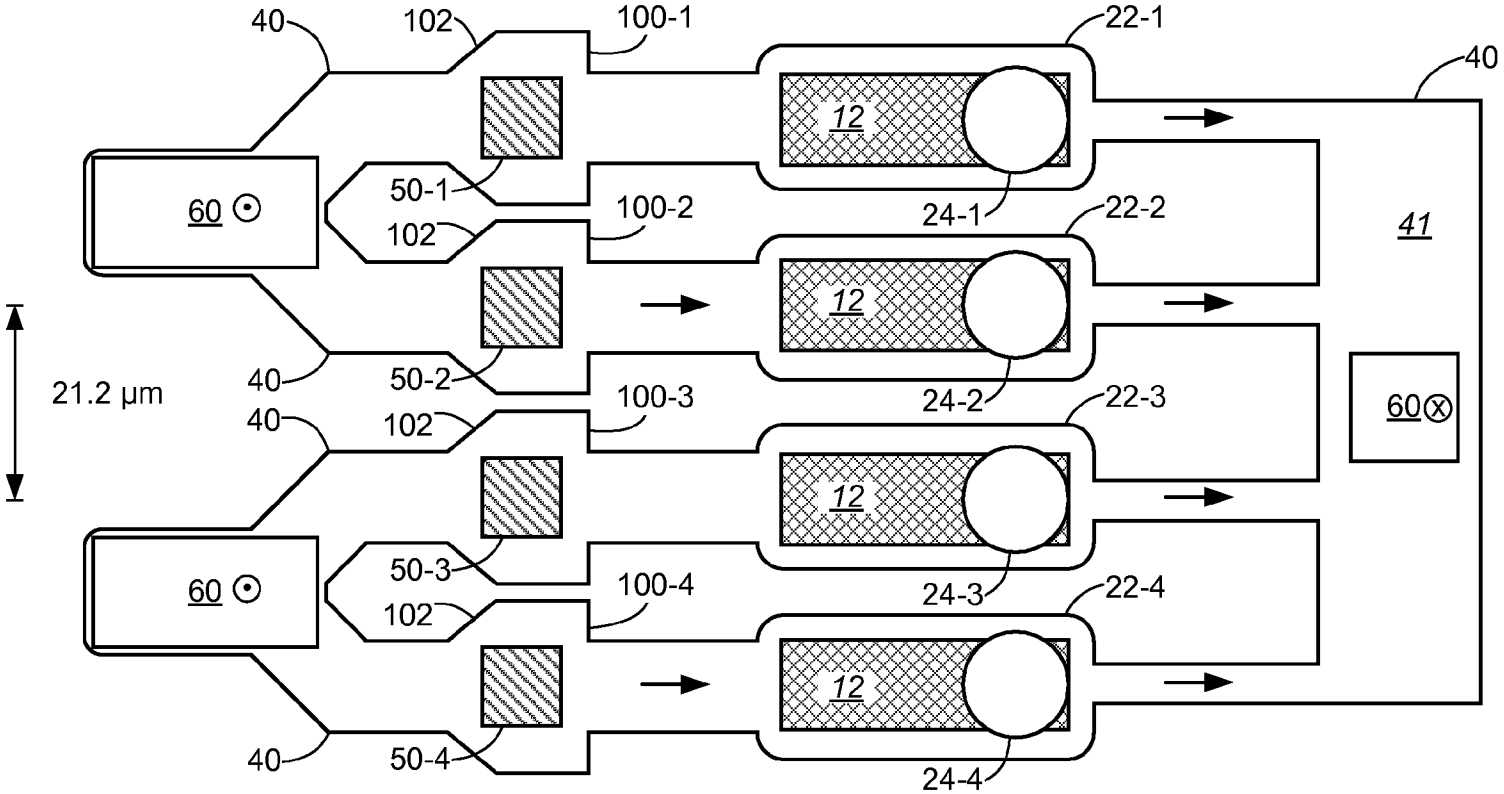

With reference to FIG. 6, another embodiment of the invention contemplates the use of a diffuser 100. The diffuser is placed in the fluid path between the source and the chamber and may be placed around a pump 50. The diffuser has an inlet 102 that expands fluid flow volume from an upstream conduit 40. As Bernoulli principles dictate, fluid velocity decreases at this point, while fluid pressure increases. With proper design, an idle time of an ink can now be increased, for example, but without otherwise reformulating the chemistry of the ink. Another benefit of this design is that the pump 50 can forcefully move fluid from the diffuser 100 into the chamber 22 and increase a chamber refill rate after the chamber is evacuated after a fluid ejection event. In other embodiments, the diffuser can be placed on the fluid outlet side 32 of the chamber.

Figure 7:
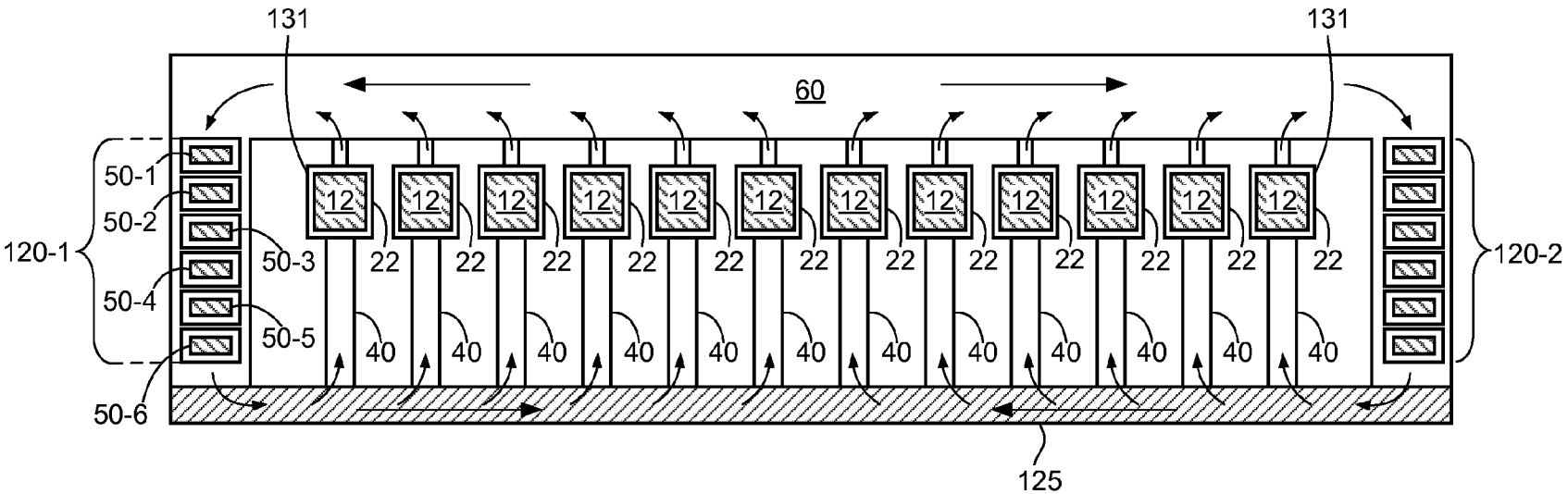

With reference to FIG. 7, a further embodiment of the invention contemplates the placement of fluid pumps 50 in one or more pumping arrays 120-1, 120-2. The arrays reside at singular or opposite ends of a chip 10. Fluid moves on the chip in the direction of the arrays and pumps through the arrays in successive handoffs from one pumping element 50-1 to a next pumping element 50-2. Dehydrated fluid in channels 60 from chambers 22 recombines with fresh fluid from a source flowing in a fluid via 125. Also, each array can reside on the substrate beyond a terminal end 131 of the fluid ejection elements 12 defined in a substantial column. The direction of the array is also generally orthogonal to the column of fluid ejection elements in a column, but other designs contemplate the array being parallel to a length of the column.

Figure 8:
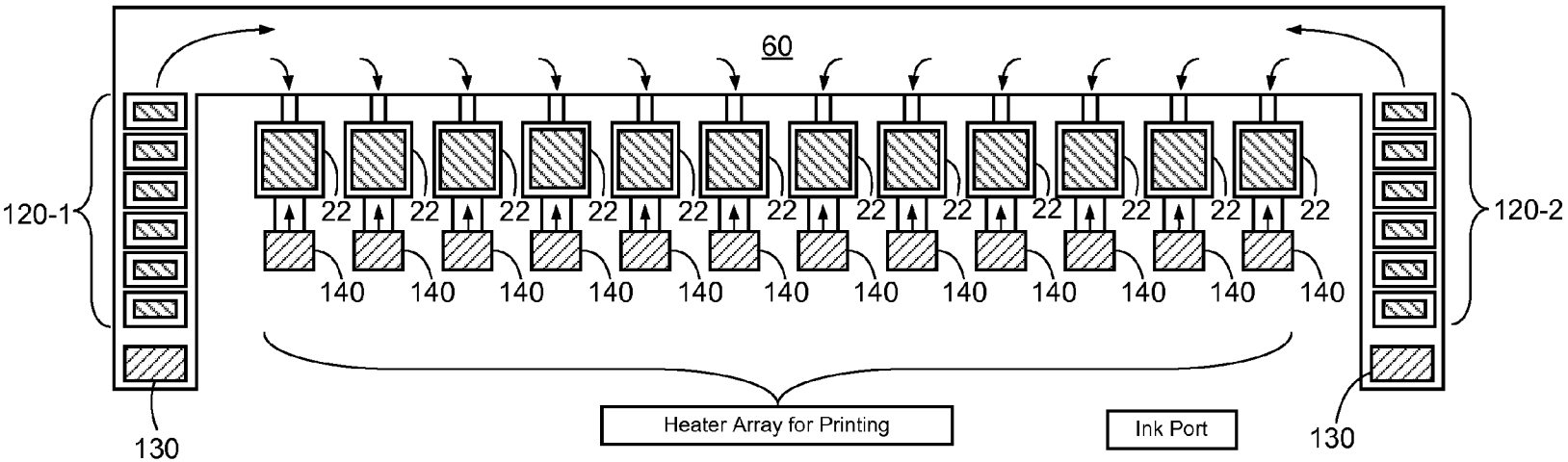

In lieu of a fluid via 125, FIG. 8 contemplates a pumping array 120-1 to move fluid throughout the chip but also a source of hydration to replenish dehydrated fluid instead of merely remixing the dehydrated fluid in a fluid reservoir. In this regard, a water port 130 is added to source water into the flow of fluid. A controller is used to time the dispersal of water and its amounts. Also, fluid for ejecting from the chambers 22 can come vertically through the chip to individual ink ports 140 dedicated to singular chambers 22. Fluid and water combines in the chambers.

Figure 9:
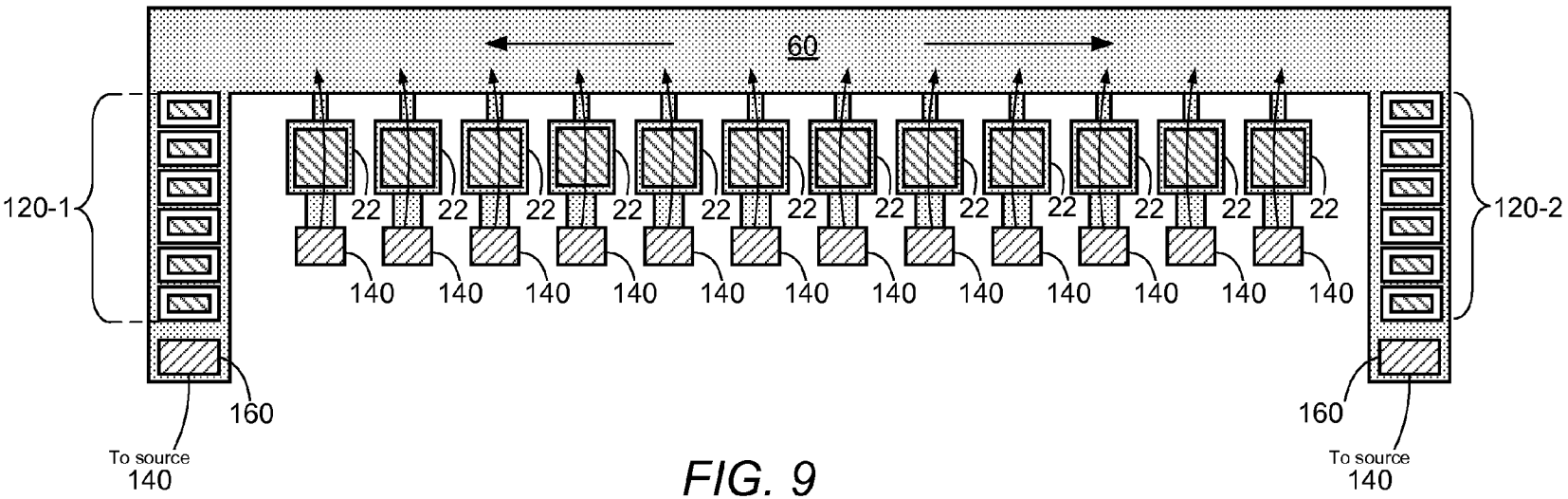

Alternatively still, FIG. 9 shows pumping of fluid that occurs with arrays 120 whereby fluid enters chambers 22 for fluid ejection but comes from ports 140. Dehydrated fluid passes from the chambers 22 through channel 60 and back through the arrays 120. The fluid is recycled vertically through the chip at port 160, back to a source, and back to port 140 for ejection.

With reference back to FIG. 2, any fluid pump 50 noted herein could be a stack of thin film layers 170 on a substrate 14. The only difference between the fluid pump and the ejection element 12 is that no nozzle orifice 24 would reside above the layers of a fluid pump. Fluid would be trapped from ejection by a solid plate (no orifice 24) and would percolate above the stack of thin film layers 170 along requisite fluid channels of the chip.

Figure 10:
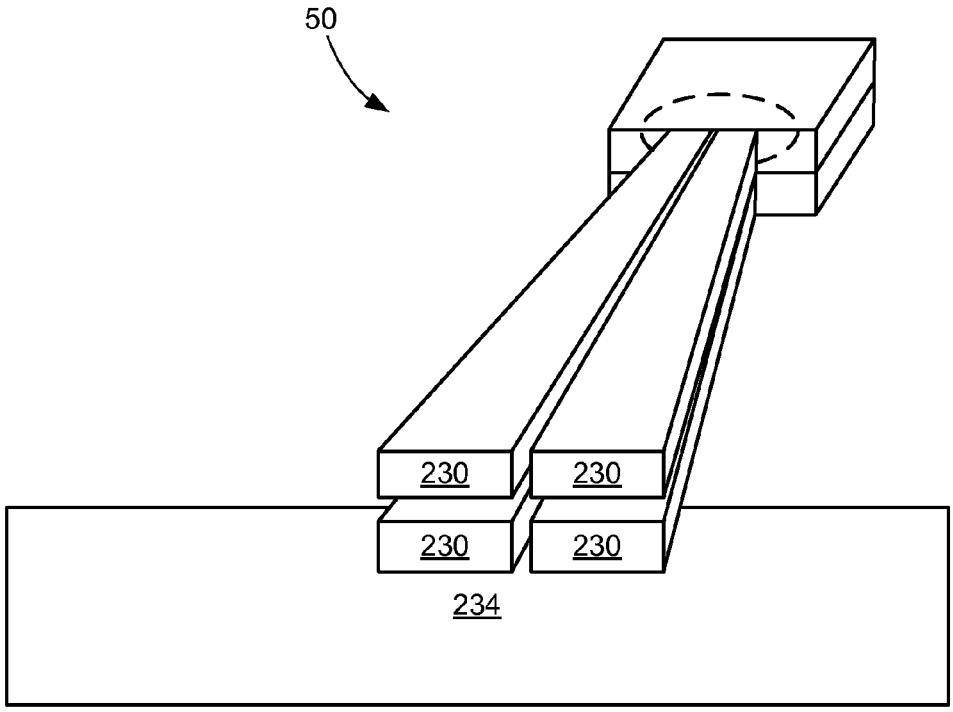
FIG. 10 (Prior Art)
FIG. 10 is a representative alternative layout of a fluid pump.

Alternatively, fluid pump 50 could be of the MEMS-type given by reference in Eastman Kodak's European Patent 1391305 or U.S. Pat. No. 6,685,303. Alternatively still, fluid pump 50 could be of the type noted in Lexmark International, Inc.'s U.S. Pat. No. 7,374,274. Incorporated herein by reference, and reproduced in-part as FIG. 10, the fluid pump 50 includes a variety of beams 230 of dissimilar metals that are caused to deflect from one another upon the application of energy from an energy source 234. The deflections cause mechanical movement that is harnessed for flowing fluid in fluid channels of a chip.

The foregoing is presented for purposes of illustrating the various aspects of the invention. It is not intended to be exhaustive or to limit the claims. Rather, it is chosen to provide the best illustration of the principles of the invention and its practical application and to enable one of ordinary skill in the art to utilize the invention, including its various modifications that follow. All such modifications and variations are contemplated within the scope of the invention as determined by the appended claims. Relatively apparent modifications include combining one or more features of various embodiments with one or more features of other embodiments.

The invention claimed is:

1. A micro-fluid ejection chip, comprising:

a substrate having a plurality of fluid ejection elements, a plurality of ejection orifices above the ejection elements to eject fluid from ejection chambers adjacent the ejection elements, the ejection chambers having a fluid inlet and outlet side;

a plurality of fluid flow conduits supplying fluid from a fluid source to each of the fluid inlet sides of the ejection chambers;

at least one fluid pump on the substrate to force the fluid from the fluid source through the fluid flow conduits and into the ejection chambers and to return the fluid to the fluid source through the fluid outlet sides of the ejection chambers; and a water port on the substrate to introduce on-demand water from a water source into the fluid to counter effects of evaporation in the fluid.

2. The micro-fluid ejection chip of claim 1, further including a plurality of fluid pumps on the substrate corresponding one each to a number of the ejection chambers.

3. The micro-fluid ejection chip of claim 2, wherein each of the plurality of fluid pumps on the substrate resides on the fluid inlet sides of the ejection chambers.

4. The micro-fluid ejection chip of claim 1, wherein the at least one fluid pump resides on the substrate on the fluid outlet sides of the ejection chambers.

5. The micro-fluid ejection chip of claim 1, further including a controller to coordinate firing logic to eject the fluid from the ejection chambers, said controller further coordinating a fluid flow rate of the at least one fluid pump.

6. The micro-fluid ejection chip of claim 5, wherein the controller further coordinates the fluid flow rate of the at least one fluid pump according to a rate of fluid refresh for the ejection chambers.

7. The micro-fluid ejection chip of claim 1, further including a supply choke in the fluid flow conduits on the fluid inlet sides of the ejection chambers.

8. The micro-fluid ejection chip of claim 7, wherein a fluid volume capacity of the supply choke on the fluid inlet sides of the ejection chambers is greater than a second fluid volume capacity of a fluid channel leading from the fluid outlet sides of the ejection chambers.

9. The micro-fluid ejection chip of claim 1, further including a fluid diffuser surrounding the at least one fluid pump, the fluid diffuser being oriented in a direction of fluid travel into the ejection chambers.

10. The micro-fluid ejection chip of claim 9, further including a plurality of fluid diffusers surrounding pluralities of fluid pumps on the substrate.

11. The micro-fluid ejection chip of claim 10, wherein each of the plurality of fluid diffusers surrounding the fluid pumps on the substrate resides on the fluid inlet sides of the ejection chambers.

12. The micro-fluid ejection chip of claim 1, further including a plurality of pumps aligned in an array on the substrate, one of the fluid conduits configured to pass the fluid over the array.

13. The micro-fluid ejection chip of claim 12, wherein the fluid ejection elements reside on the substrate in a substantial column and the array resides on the substrate beyond a terminal end of the column.

14. The micro-fluid ejection chip of claim 12, further including a second plurality of pumps aligned in a second array on the substrate, the array and the second array residing on the substrate on substantially opposite ends thereof.

15. A micro-fluid ejection chip, comprising:

a substrate having a plurality of fluid ejection elements formed as thin film layers, a plurality of ejection orifices above the ejection elements to eject fluid from ejection chambers adjacent the ejection elements, the ejection chambers having a fluid inlet and outlet side;

a plurality of fluid flow conduits supplying fluid from a fluid source to each of the fluid inlet sides of the ejection chambers, a plurality of fluid channels leading from the fluid outlet sides of the ejection chambers to carry back fluid to the fluid source;

at least one fluid pump on the substrate to force the fluid from the fluid source through the fluid flow conduits into the ejection chambers and to return the fluid to the fluid source through the fluid outlet sides of the ejection chambers;

a controller to coordinate firing logic to cause ejections of the fluid from the ejection chambers and to coordinate a fluid flow rate of the at least one fluid pump relative to the ejections of the fluid from the ejection chambers; and a water port on the substrate to introduce on-demand water from a water source into the fluid to counter effects of evaporation in the fluid.

16. The micro-fluid ejection chip of claim 15, wherein a fluid volume capacity of the fluid flow conduits on the fluid inlet sides of the ejection chambers is greater than a second fluid volume capacity of the fluid channels leading from the fluid outlet sides of the ejection chambers.

17. The micro-fluid ejection chip of claim 15, further including a fluid diffuser surrounding the at least one fluid pump, the fluid diffuser being oriented on the fluid inlet sides of the ejection chambers in a direction of fluid travel into the ejection chambers.

18. The micro-fluid ejection chip of claim 17, further including a plurality of fluid diffusers surrounding pluralities of fluid pumps on the substrate.

19. The micro-fluid ejection chip of claim 15, wherein the at least one pump on the substrate is a plurality of electromechanical beams actuated by the controller.

20. The micro-fluid ejection chip of claim 15, wherein the at least one pump on the substrate is a second plurality of thin film layers formed on the substrate.

21. The micro-fluid ejection chip of claim 20, wherein the second plurality of thin film layers on the substrate forming the at least one pump on the substrate is a same stack of thin film layers on the substrate that define the plurality of fluid ejection elements.

* * * * *